United States Patent [19]

Schrum

[11] Patent Number: 4,495,217

[45] Date of Patent: Jan. 22, 1985

[54] METHOD FOR APPLYING POWDERED COATINGS

[76] Inventor: Timothy J. Schrum, 125 N. Church St., Mohnton, Pa. 19540

[21] Appl. No.: 369,594

[22] Filed: Apr. 19, 1982

[51] Int. Cl.[3] ..... B05D 1/04; B05D 3/02

[52] U.S. Cl. ..... 427/27; 427/33; 427/189

[58] Field of Search ..... 427/33, 27, 195, 189; 118/632, 641, 70, 319, 308, 642

[56] References Cited

U.S. PATENT DOCUMENTS 2,573,835 11/1951 Pyar ..... 118/308

3,865,610 2/1975 Goodridge et al. ..... 427/195

FOREIGN PATENT DOCUMENTS 1472079 4/1977 United Kingdom ..... 427/27

*Primary Examiner*—Norman Morgenstern

*Assistant Examiner*—Ken Jaconetty

[57] ABSTRACT

Relatively small parts are powder coated without fixturing by placing the parts on a heat conductive surface and the powders are distributed over the exposed surfaces of the parts. The powders on the surfaces of the parts are heated to fuse the powders, as by radiant heat, while the heat conductive surface is kept at a temperature below that at which overspray powders on the conductive surface will become tacky. In a preferred embodiment, the heat conductive surface is an endless belt which advances the parts past a powder coating station, past a top heating-bottom cooling station and then to discharge.

9 Claims, 2 Drawing Figures

METHOD FOR APPLYING POWDERED COATINGS

TECHNICAL FIELD

This invention relates to methods and apparatus for coating substrates with powdered fusible coating materials and more particularly to methods and apparatus for powder coating relatively small parts.

BACKGROUND ART

Powder coating processes may generally be defined for purposes of this specification as those in which fusible coating materials are distributed over a substrate and the distributed coating materials are fused into a continuous film. Sometimes the substrates are preheated to supply the heat required to melt the coating powders, sometimes the powders are applied to cold substrates, and the powders are melted in a postheat oven, and sometimes both postheat and preheat steps are utilized.

In common practice, coating powders are based on thermoplastic or thermosetting polymeric materials but they can also include such things as ceramics and metals. In any instance, the essential requirement is that the melting point of the coating powders must be sufficiently low so that they can be melted without degrading the substrate. It also should be noted that in the case of thermosetting coating powders, a postheat is usually required to complete the cure and fully develop the properties of the coating.

Examples of commonly used powder coating processes include fluidized bed, electrostatic spraying, cloud chambers, hot flocking, fluid transport as well as various combinations of these processes.

One of the principal advantages in using powdered coatings is that no solvents or carrier liquids are required. Not only does this reduce the cost of the coating materials, but also costly volatile recovery systems needed for liquid solvent coating materials to meet the requirements of governmental environmental protection agencies are avoided.

A recurring problem, common to all powder coating systems, is that the substrate must be supported by some type of fixture when the substrate is being coated. For example, a substrate may be hung on a J-hook or, if the part is rather large, a metal wire or rod may be tack-welded to the substrate. In any instance, the point at which the substrate is supported will not be coated and the bare spot often must be touched-up with a patching compound. The importance of patching uncoated spots is more than a matter of esthetics since a bare spot presents a point where underfilm corrosion may be begin. Continous, void free coatings are also required when electrical insulation is important.

When coating substrates of moderate size and upwards, such as busbars, wall panels, or dishwasher baskets, it is usually only a matter of minor annoyance to fixture the part and patch the holding point; but when the parts are small, such as thumbtacks, bra clips, and zipper pulls, fixturing and patching make the coating process so labor intensive that it may no longer be cost competitive with solvent based systems.

A related problem, which at first may escape notice, is that powder overspray coats the fixtures and this coating must be stripped off frequently, sometimes each time the fixture is used. In extreme situations, the part and the fixture coat together and cannot be separated without cutting one piece loose from the other. Overspray coatings may be burned off the fixtures or they may be removed with solvents. In either event, an additional operation is required, and, no matter if solvents or burning is used, waste materials are generated that require collection and disposal.

SUMMARY OF THE INVENTION

Accordingly, it is the principal object of this invention to eliminate the need to fixture parts in powder coating processes.

Another object of this invention is to eliminate the need to patch bare spots when coating small parts in powder coating processes.

Another object of this invention is to minimize the manual labor required to coat large numbers of relatively small parts.

Another object of this invention is to provide methods and means for recovering overspray for reuse when powder coating relatively small parts.

Another object is to provide methods and means for applying thin film powder coatings (e.g. 0.001 to 0.005 inches) to substrates without fixturing the part.

These and other objects of this invention are achieved by placing the parts to be coated on a surface having relatively good heat conductivity; spraying, preferably electrostatically, the part with a coating powder; and heating the coating powders, as by radiant heat, while the surface upon which the part rests is maintained at a temperature well below the melting point of the coating powder. Surprisingly, an excellent coating is obtained while at the same time, the powder overspray does not fuse either to the surface or to the edges of the part where the part contacts the surface.

In the simplest embodiment of this invention, the part is laid on a metal plate that is cored to circulate cooling water. The part, which does not have to be preheated, is placed on this surface; the part is electrostatically coated with the powdered coating material; and a radiant heater is positioned over the part to melt the powder on the surface of the part. The overspray does not melt on the plate nor does it attach itself to the edge of the part. After the part is removed from the plate, the overspray powders are removed and collect for reuse, as by dusting or vacuuming. If the part is to be coated on both sides, it is inverted on the plate and the operation repeated.

The above described coating method can readily be automated as, for example, by substituting an endless stainless steel belt for the plate. The parts are laid on one end of the belt and progressively advanced, by forward movement of the belt, past a coating station, top heating-bottom cooling station, and then to discharge at the end of the belt. The belt may be maintained at a relatively cool temperature at the heating station by any conventional means such as, for example, spraying a coolant liquid against the underside of the belt.

This invention can be better understood by reference to the drawings in which.

Figure 1:
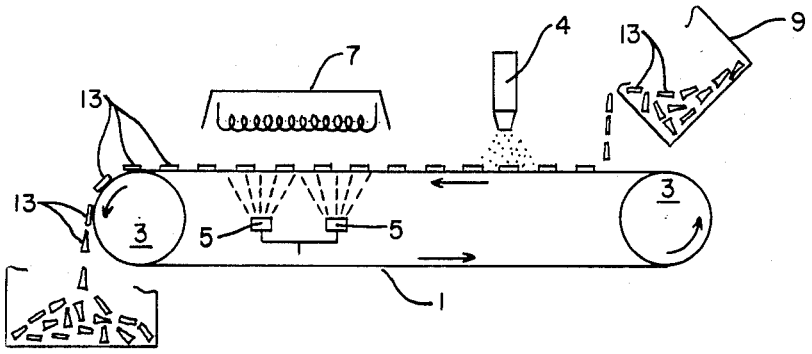
FIG. 1 is a schematic side view of apparatus suitable for use in this invention.

In more detail, there is illustrated in FIG. 1 a continuous steel conveyor belt that is guided and moved by rollers 3. An electrostatic spray gun 4 is located over the belt, a cooling device such as water sprays 5 is located on the underside of the conveyor belt 1, and a radiant heater 7 is positioned over conveyor belt 1 directly above the water sprays 5. Parts to be coated 13 are distributed on the conveyor belt from a supply box 9 and, are discharged into a collection box 11.

In operation, parts to be coated 13 are distributed over the conveyor belt 1 as by dropping them from a supply box 9. Parts 13 advance with the moving conveyor belt 1 to a station where fusible coating powders are sprayed by nozzle 4 over the exposed surfaces of the parts. It is generally useful for the spray nozzle 4 to be of an electrostatic type in which case the conveyor belt 1 should be grounded.

After the parts 13 are coated with powder, the conveyor belt 1 advances the parts to the radiant heater 7 where enough heat is supplied to melt the coating powders and so that they will flow-out over the exposed surfaces of the parts 13. At the same time, the conveyor belt 1 is being chilled by water sprays 5 which maintain it a sufficiently low temperature to prevent the overspray powder from sticking to either the conveyor belt 1 or the edges of parts 13. The conveyor belt 1 continues its advance while the coating cools or curesto a point where its no longer tacky. The parts 13 are then discharged over the end of the conveyor belt 1 into a collection box 11.

If the coating powders are thermosetting, the heat supplied by the radiant heater 7 must be sufficient to complete the cure of the coating or, in the alternative, the parts 13 may be post heated at another station.

It is apparent that the apparatus as illustrated in FIG. 1 cannot coat those portions of the parts 13 that rest on the steel conveyor belt 1. To coat both sides, the parts 13 must be inverted and run through the device of this invention a second time. The parts 13 may be oriented by hand on the belt 1 or they may be turned over by automatic devices such as illustrated in FIG. 2.

Figure 2:
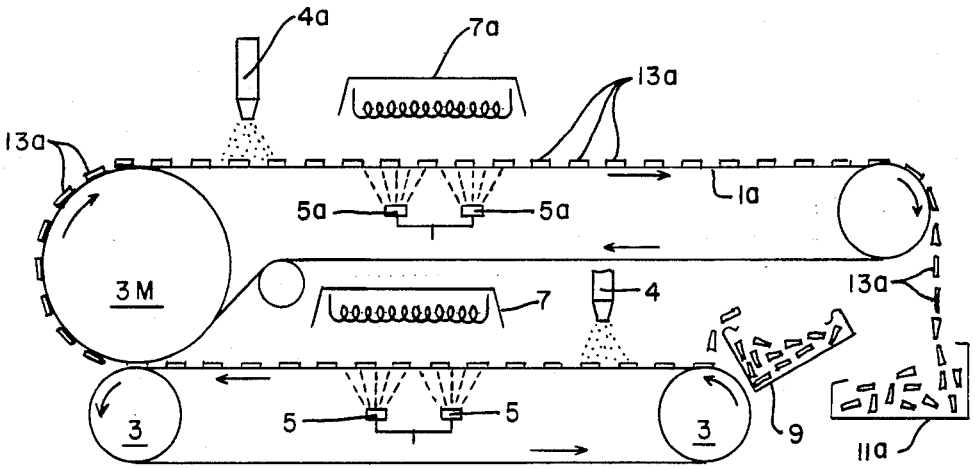
FIG. 2 is a schematic side view of the apparatus of this invention illustrating a magnetic belt for inverting the parts being coated.

In FIG. 2 a device is illustrated in which the parts are reversed by means of a belt 1*a* that is magnetically activated at the discharge end of the first belt 1. The parts 13 are magnetically lifted from initial conveyor belt 1, as for example by utilizing a magnetic roller 3M, so that the uncoated surfaces will face upward on the top of the magnetic belt 1*a*. By these means a second coating can be applied at spray nozzle 4*a*, auxiliary radiant heat 7*a* and auxiliary cooling sprays 5*a*. After the parts 13*a* have been coated on both sides, they are discharged into a collection box 11*a*.

The above described method in apparatus is believed to be novel although some of the principals upon which it is based can be found in the prior art. For example, it is known in U.S. Pat. No. 3,226,245 that a holding and masking device may be kept at a temperature below the melting point of plastic powders by circulating a coolant liquid through them.

U.S. Pat. No. 2,987,413 illustrates a method for coating small parts without fixturing. Here, after the parts have been heated above the melting point of the coating powder, they are dropped into a fluffed bed of coating powders. After the coating powders are fused over the surface of the parts, they are removed from the bed of powder, as by a wire basket. The surface of these parts will not be fully fused out and have what is sometimes referred to as a sugar coating. This is not always objectionable and, if the coating is solely for a functional purpose such as electrical insulation, it may be of no consequence. Also, since a slight sugar coating on the surface of the coated part provides a matte rather than a shiny finish, it is sometimes preferred for esthetic reasons.

Yet another method and apparatus for coating small parts without fixturing is disclosed in U.S. Pat. Nos. 3,965,858 and 4,000,338. These patents make use of vibrating container that, by compound vibratory or eccentric motions maintains the coating powder in a fluffed condition and, at the same time, causes the parts to move up an incline plane for discharge over a side wall of the vibratory container. For this process to be operative, the parts must be preheated and, if a shiny surface rather than a matte finish is desired, post heating is required.

One limitation common to both of the above processes is that it is very difficult to obtain thin film coatings when preheated parts are dropped into a fluffed bed of powder. For example, using the method of the instant invention, coatings with thicknesses in the range of 1 to 5 mils can be applied with ease whereas, when a bed of powder is used, it is difficult to obtain coatings less than 8 mils and 12 to 15 mils is considered a rather normal range.

I claim:

1. A method for applying powdered coatings to relatively small parts without fixturing, comprising the steps of:

placing the parts on a heat conductive surface;

distributing the fusible coating powders over the exposed surfaces of the part;

heating the powders distributed on the parts to above their melting point while maintaining te heat conductive surface at a temperature below which any overspray coating powders on the conductive surface become tacky.

discontinuing the heating; cooling the powders below their melting point; and removing the parts from the heat conductive surface after the coatings have solidified.

2. A method according to claim 1 wherein the heat conductive surface is an endless belt.

3. A method according to claim 2 wherein the parts are carried past a coating station and then past a top heatingbottom cooling station by forward movement of the belt.

4. A method according to claim 1 wherein the powders are distributed by spraying.

5. A method according to claim 4 wherein the powders are electrostatically sprayed.

6. A method according to claim 1 wherein the coatings are less than 0.002 inches thick.

7. A method according to claim 3 wherein the powder overspray is removed from the belt before receiving additional uncoated parts.

8. A method according to claim 1 wherein the coated parts are turned over and coated on their other sides.

9. A method according to claim 8 wherein the part are magnetically attractable and are turned over magnetically.

* * * * *